United States Patent [19]

Kausträter

[11] 4,149,448

[45] Apr. 17, 1979

[54] AUTOMATIC GUN MOUNTING SYSTEM

[75] Inventor: Gert Kausträter, Augsburg, Fed. Rep. of Germany

[73] Assignee: Industrie-Werke Karlsruhe Augsburg Aktiengesellschaft, Fed. Rep. of Germany

[21] Appl. No.: 816,177

[22] Filed: Jul. 15, 1977

[30] Foreign Application Priority Data

Jul. 16, 1976 [DE] Fed. Rep. of Germany ... 7622506[U]

[51] Int. Cl.[2] ..... F41F 19/00

[52] U.S. Cl. ..... 89/37 B; 89/37 E

[58] Field of Search ..... 89/37 R, 37 B, 37 E, 89/37 K, 40 B

[56] References Cited

FOREIGN PATENT DOCUMENTS 878,976 10/1961 United Kingdom ..... 89/37 E

*Primary Examiner*—Stephen C. Bentley

*Attorney, Agent, or Firm*—McGlew and Tuttle

[57] ABSTRACT

An automatic gun mounting system, comprises a weapon support having respective end portions with respective first and second angularly spaced bearing bushings. A gun which has a recoiling barrel, particularly for armored wheeled half track or full track motor vehicles has a gun body portion with respective outwardly extending bearing pins engaged in respective first and second bearing bushings. A resilient assembly is disposed between each of the pins and its associated bushing and it includes inner and outer radially spaced apart concentric bushing rings with a rubber ring disposed therebetween undetachably interconnecting the outer and inner bushing rings. The rubber ring is advantageously vulcanized to the respective inner and outer rings.

4 Claims, 2 Drawing Figures

AUTOMATIC GUN MOUNTING SYSTEM

FIELD AND BACKGROUND OF THE INVENTION

This invention relates in general to gun constructions and, in particular, to a new and useful automatic gun having a recoiling barrel, particularly for armored wheeled half track or full track motor vehicles, in which the gun is fixed centrally of the gun mount in a swivel part and the front bearings of the weapon are rigidly connected to the weapon.

DESCRIPTION OF THE PRIOR ART

As a rule, automatic guns need a weapon support, i.e., a gun carriage or other such means. Basically, distinction is made between rigid, buffered and floating mounts. In the rigid mount, weapon and weapon support are positively connected to each other and the maximum force $F_{max}$, acting on the weapon support, can be defined as follows:

(a) in rigidly locked weapons with a fixed barrel $$F_{max}=D^2(\pi/4)\cdot P_{max}$$

where D=caliber and $P_{max}$=maximum gas pressure;

(b) in mass-locked weapons $$F_{max}=P_{Fmax},$$

where $P_{Fmax}$=the maximum force acting on the breech-closing or buffer spring of the recoiling breech, and, finally, (c) in other kinds of support $$F_{max}>P_{Fmax}<D^2(\pi/4)\cdot P_{max}$$

The above-mentioned action of force becomes manifest, inter alia, also by the occurrence of relatively high reaction forces. These are transmitted as impulsions through the rigid weapon bearings from the recoiling barrel into the weapon support, gun carriage, or turret, as well as into the absorbing roof of the vehicle, with the produced stresses depending on the firing rate. Oscillations are thereby incited in the system comprising the parts mentioned. It is easily understandable that such oscillations negatively affect the score, that is, the more weight-saving and self-supporting the roof structure for the gun mount is, the more pronounced is the unfavorable effect the resulting oscillations have on the accuracy of fire.

SUMMARY OF THE INVENTION

To eliminate these drawbacks and disadvantages of the prior art, the present invention is directed to a system gunweapon support vehicle in which the conditions of vibration are effectively improved by relatively simple means and in a manner such that a negative influence on the firing score is prevented in any event.

To this end, and in accordance with the invention, the front bearings of the weapon are each provided with two pins, bolts or the like, which are arranged in pairs so as to be offset relative to each other by a definite angular distance and which serve the purpose of engaging at least one resilient element which is conformable to the configuration of the pin and bears against a bushing which is fixedly secured to the weapon support.

In a development of the invention, the resilient element substantially comprises two bushings, rings or the like, which are radially spaced from each other by a definite distance and undetachably connected to each other by means of a rubber ring bridging the radial distance.

In accordance with the invention, the undetachable connection of the bushings, rings or the like to the rubber ring is accomplished by vulcanization. Still another feature of the invention is that the rubber ring is made of prestressed natural rubber.

The invention offers a number of advantages:

Aside from the fact that the inventive design is extremely simple and inexpensive and makes it possible to easily re-equip existing weapon systems, the impulses induced in the inventive system are so strongly damped by the anti-vibration elements or resilient cushioning provided between the bearings which are rigidly connected to the weapon and the weapon support that they no longer can be fully imparted to the elements which follow. The system thus quieted or damped entails a substantial improvement in the accuracy of fire of the weapon.

As is well known, since the degree of hardness of resilient elements can be varied, for example, in terms of the Shore hardness scale, in accordance with, or with respect to, the reaction forces of the weapon, the invention can be applied correspondingly to a variety of systems of automatic guns. In addition, while employing the resilient elements in accordance with the invention, and taking into account their spatial effect, the position in which the weapon is mounted is of quite secondary importance. Consequently, the feed of ammunition may be provided from below, or alternatively, laterally.

Accordingly, it is an object of the invention to provide an automatic gun mounting system which comprises a weapon support having respective end portions with respective first and second angularly spaced apart bearing bushings in respect to a gun which is mounted on a body portion and which has a recoiling barrel and, wherein, the body portion includes outwardly extending bearing pins engaged in respective ones of the bearing bushings with a resilient assembly disposed between the pins and the bushings which comprise inner and outer bushing rings and a rubber ring between the inner and outer rings which undetachably interconnects the other.

A further object of the invention is to provide an automatic gun mounting system which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
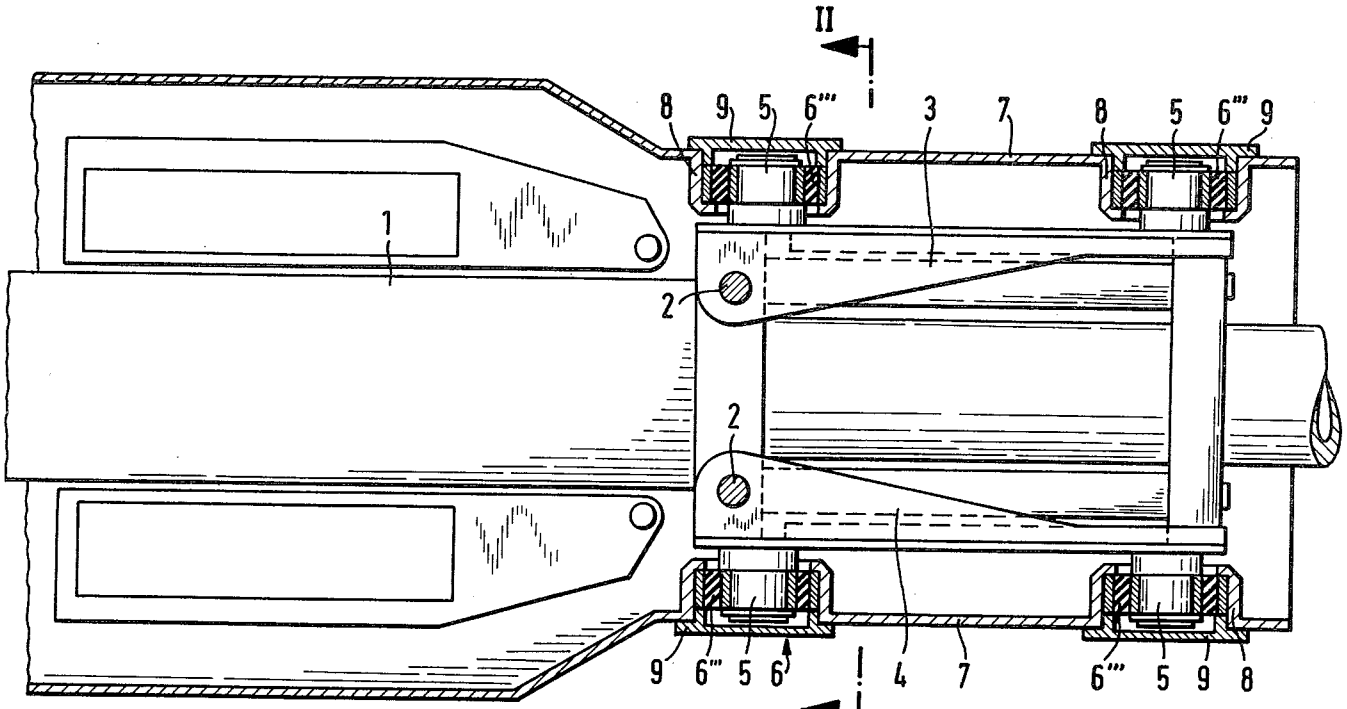
FIG. 1 is a partial lateral elevational view and partial sectional view of an automatic gun mounting system constructed in accordance with the invention.
Figure 2:
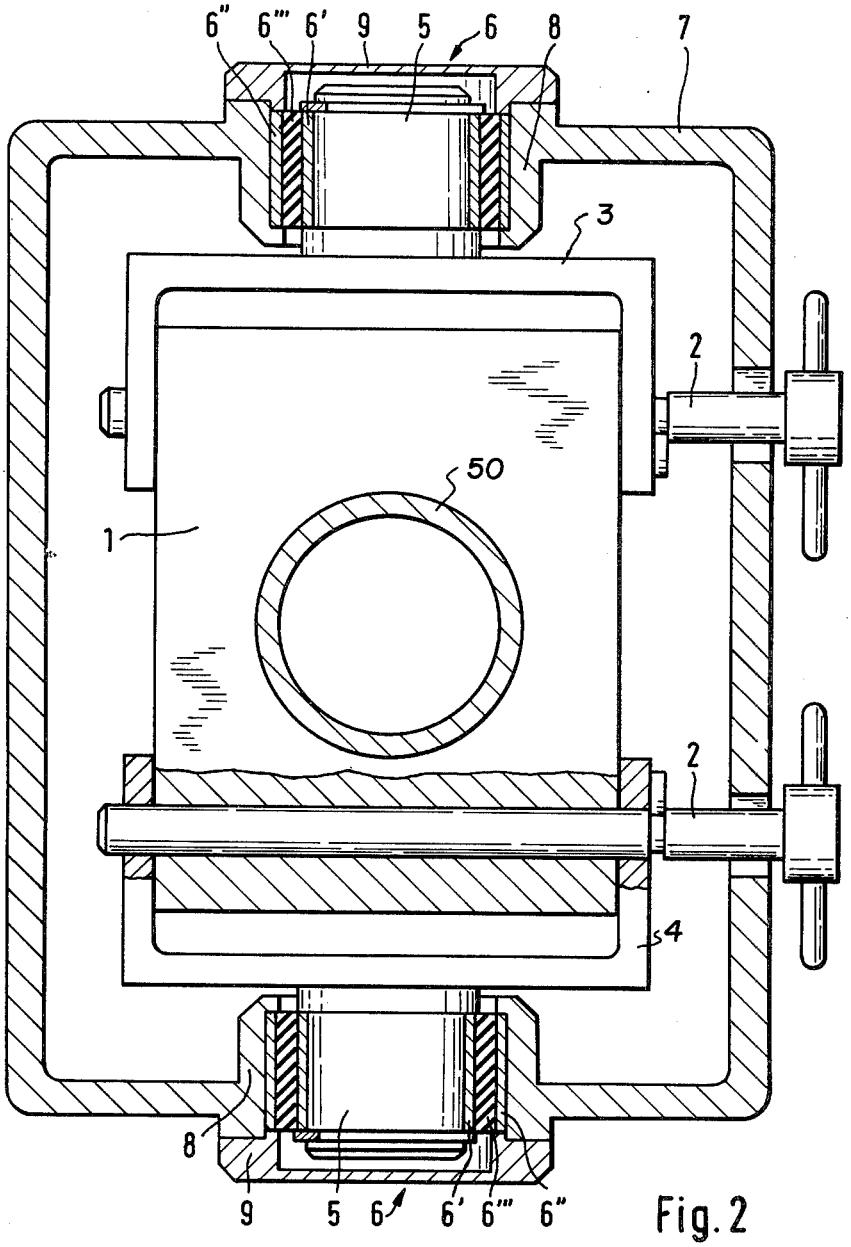
FIG. 2 is a section taken along the line II—II of FIG. 1.

Referring to the drawings in particular, the invention embodied therein, comprises an automatic gun mounting system for a gun, generally designated 50, which has a recoiling barrel and a body portion 1 and is particularly used for armored wheeled half track or full track motor vehicles on which the gun is fixed centrally of the gun mount in a swivel part.

The body 1 of the gun or weapon is connected firmly but detachably by mounting means including upper and lower bearings 3 and 4. The weapon is provided at its front side with connecting pins 2, which extend through the body 1. Weapon bearings 3 and 4 are each provided with two pins, bolts, or the like 5, arranged in pairs in which they are offset relative to each other by a definite angular distance around the gun barrel 50, for example, 180°.

Pins, bolts or the like 5 serve the purpose of engaging at least one resilient element 6, the configuration of which corresponds to that of the pin, bolt, etc. Each of the resilient elements 6 comprises an inner ring 6', an outer ring 6'', and a prestressed rubber ring 6''' vulcanized therebetween. The inner and outer rings 6' and 6'' are advantageously made of steel, and rubber ring 6''' is made of natural rubber.

Resilient elements 6 are seated in bushings 8 which are provided for this purpose in weapon support 7 and against which outer rings 6'' bear. To secure elements 6 in place, bushings 8 are covered with retaining caps 9.

In order to guide and return the weapon into its zero position, one of the pairs of pins 5, each with one resilient element 6 (or with more such elements, if provided) serves as a connection to the weapon support.

While a specific embodiment of the invention has been shown and described in detail to illustrate the application of the principles of the invention, it will be understood that the invention may be embodied otherwise without departing from such principles.

What is claimed is:

1. A gun mounting, comprising a weapon support frame having first and second sets of axially spaced bearing bushings, each set comprising first and second oppositely arranged bushings, a gun barrel extending between said first and second oppositely arranged bushings of each of said two sets, mounting means connected to said gun barrel and having a radial bearing pin extending outwardly therefrom into engagement with each of said first and second bearing bushings of each of said sets, and a resilient assembly disposed between each of said pins and its associated bearing bushing including at least one resilient element which is conformable to the configuration of each of said pins and bears against a respective bearing bushing.

2. An automatic gun mounting system, as claimed in claim 1, wherein said resilient assembly includes inner and outer bushing rings which are radially spaced apart and including a rubber ring disposed between said bushing rings bridging the radial distance therebetween and undetachably interconnecting them.

3. An automatic gun mounting system, as claimed in claim 2, wherein said rubber ring is vulcanized to said first and second bushings.

4. An automatic gun mounting system, as claimed in claim 2, wherein said rubber ring is made of a prestressed natural rubber.

* * * * *